US010011970B2

(12) United States Patent
DeNeef et al.

(10) Patent No.: US 10,011,970 B2
(45) Date of Patent: Jul. 3, 2018

(54) VIBRATING DEVICE AND METHOD FOR INSERTING A FOUNDATION ELEMENT INTO THE GROUND

(71) Applicant: CAPE HOLLAND HOLDING B.V., Beilen (NL)

(72) Inventors: Laurens DeNeef, Dwingeloo (NL); Peter Kleine, Kerkenveld (NL)

(73) Assignee: CAPE HOLLAND HOLDING B.V., Beilen (NL)

( * ) Notice: Subject to any disclaimer, the term of this patent is extended or adjusted under 35 U.S.C. 154(b) by 0 days.

(21) Appl. No.: 15/316,633

(22) PCT Filed: Jun. 9, 2015

(86) PCT No.: PCT/NL2015/050417
§ 371 (c)(1),
(2) Date: Dec. 6, 2016

(87) PCT Pub. No.: WO2015/190919
PCT Pub. Date: Dec. 17, 2015

(65) Prior Publication Data

US 2017/0145650 A1 May 25, 2017

(30) Foreign Application Priority Data

Jun. 10, 2014 (NL) ..... 1040841
Nov. 25, 2014 (NL) ..... 2013871

(51) Int. Cl.
*E02D 17/18* (2006.01)
*E02D 7/18* (2006.01)
(Continued)

(52) U.S. Cl.
CPC ..... *E02D 7/18* (2013.01); *B06B 1/16* (2013.01); *E02D 27/425* (2013.01); *E02D 2200/146* (2013.01); *E02D 2300/0001* (2013.01)

(58) Field of Classification Search
CPC ..... E02D 7/18; E02D 2200/145; B06B 1/16
See application file for complete search history.

(56) References Cited

U.S. PATENT DOCUMENTS 3,530,947 A 9/1970 Gendron
4,018,290 A * 4/1977 Schmidt ..... E02D 7/18 173/49
(Continued)

FOREIGN PATENT DOCUMENTS

DE 202011110294 U1 5/2013
FR 1178589 A 5/1959
(Continued)

OTHER PUBLICATIONS

International Search Report and Written Opinion dated Mar. 15, 2016 for PCT Application, PCT/NL2015/050417 filed Jun. 9, 2015.

*Primary Examiner* — Benjamin F Fiorello

(57) ABSTRACT

The invention relates to a vibrating device, kit and method for inserting a foundation element into the ground, wherein the vibrating device comprises: —a clamping mechanism (18) for fixedly clamping the foundation element (12); —a vibrator block (32) configured to provide a vibration for the purpose of inserting the foundation element (12) into the ground, wherein the vibrator block (32) is provided with resilient elements (6); —a rotation mechanism operatively connected to the vibrator block (32) and configured to rotate the vibrator block (32) with the resilient elements (6), wherein the clamping mechanism (18) fixedly holds the
(Continued)

Figure 1A:
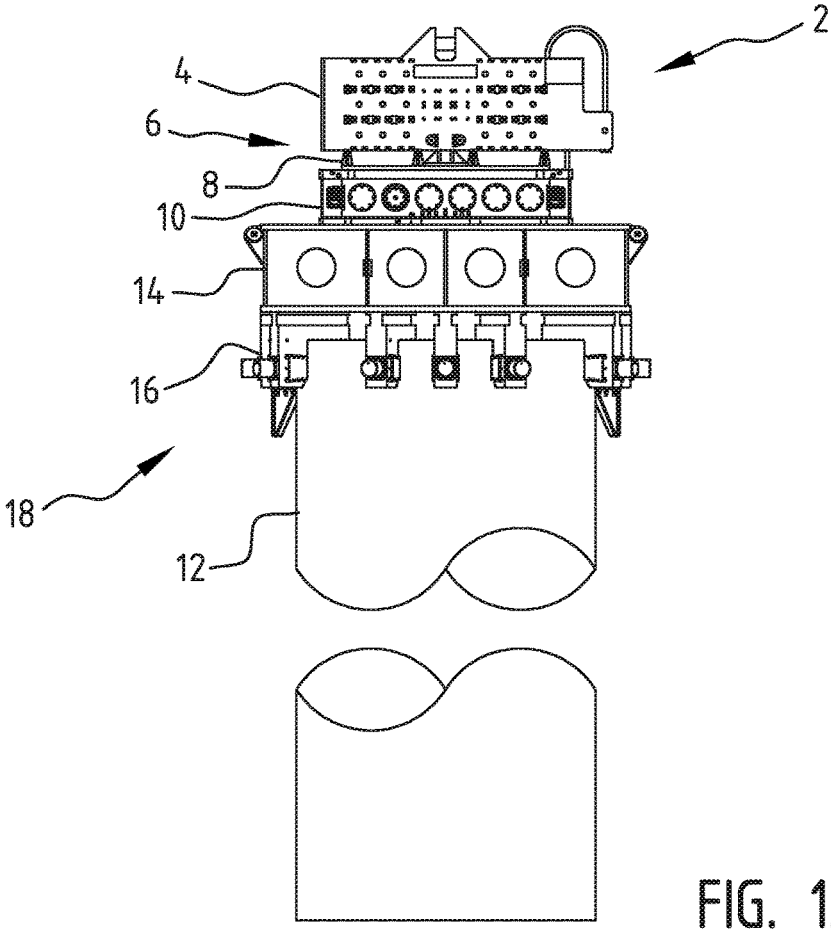
Figure 1B:
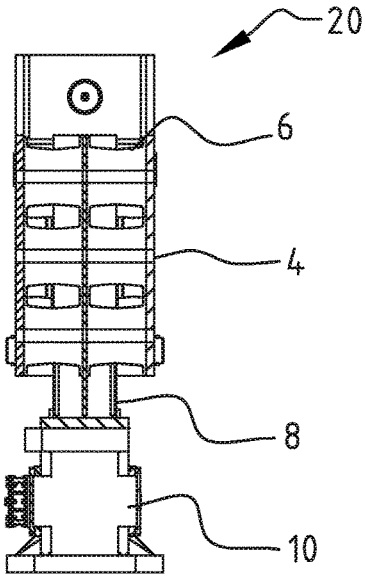
Figure 1C:
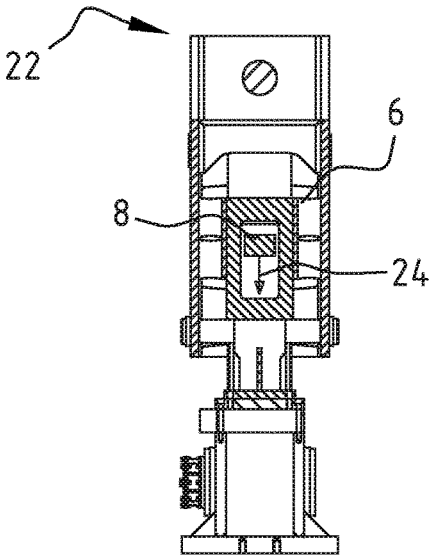
Figure 1D:
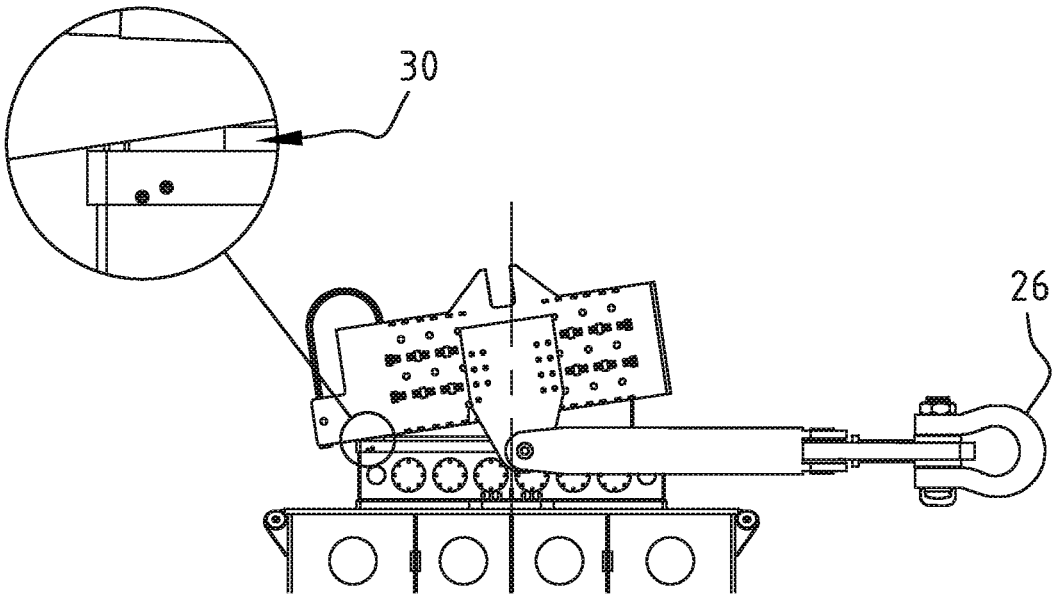

foundation element (12); and —a fixation mechanism (40) configured to apply a prestress to the resilient elements (6).

18 Claims, 16 Drawing Sheets

(51) Int. Cl.
*B06B 1/16* (2006.01)
*E02D 27/42* (2006.01)

(56) References Cited

U.S. PATENT DOCUMENTS 4,100,974 A * 7/1978 Pepe ..... E02D 7/18 173/49
4,143,719 A * 3/1979 Furukawa ..... E02D 7/18 173/1
4,645,017 A * 2/1987 Bodine ..... E02D 7/18 173/162.1
5,117,925 A 6/1992 White
5,168,938 A * 12/1992 Sano ..... E02D 7/18 173/11
5,355,964 A * 10/1994 White ..... E02D 7/18 173/1
5,653,556 A 8/1997 White
6,672,805 B1 * 1/2004 White ..... E02D 7/18 173/42
6,691,797 B1 * 2/2004 Hart ..... E02D 7/18 173/128
7,080,958 B1 * 7/2006 Morris ..... E02D 7/18 173/162.1
2011/0081208 A1 * 4/2011 White ..... E02D 7/18 405/249

FOREIGN PATENT DOCUMENTS

FR 2580306 A1 10/1986
GB 2095731 A 10/1982
WO 2013/051929 A1 4/2013

* cited by examiner

VIBRATING DEVICE AND METHOD FOR INSERTING A FOUNDATION ELEMENT INTO THE GROUND

The invention relates to a vibrating device for inserting a foundation element, such as a foundation pile for a wind turbine, into the ground. Such foundation elements can be inserted into the ground here both on land and at sea.

Known in practice are vibrating devices for placing a foundation pile on which a construction such as a wind turbine can be mounted. Such vibrating devices make use of the vibration of a solid or tubular pile, wherein this pile is vibrated into the ground with a vibrator block. Such blocks are usually connected to the upper side of the foundation pile in a substantially vertical position of the foundation pile. A good match is required here between the dimensions of the foundation pile and the associated block. This is usually time-consuming in practice, with a relatively poor view of the coupling because of the great distance, and with a relatively great chance of inaccuracies with the additional increased chance of accidents.

It is also known in practice to arrange a vibrator block on a foundation pile while this latter is in a horizontal position. Great forces are required here to move the foundation pile from the horizontal position to the vertical vibration position with the vibrating device. During the rotation the various components of the vibrator block are exposed here to these great forces, usually at an unfavourable angle, so that the lifespan of the vibrator block is limited and/or additional maintenance is required. Components such as resilient elements of the vibrating device are exposed in such conventional devices to changing bending, thereby making it more difficult to obtain a correct angle of rotation and thereby connect the vibrating device to the foundation pile. It is in addition found that resilient elements, particularly resilient elements which make use of elastomers, display a relatively great variation in strength, so that breakage can occur after a period of time, particularly in the case where great loads occur. This increases the chance of accidents during positioning of the foundation element.

An object of the present invention is to obviate or reduce the above problems and to provide an effective vibrating device for inserting a foundation element into the ground.

This object is achieved using the vibrating device for inserting a foundation element into the ground according to the present invention, wherein the vibrating device comprises:

- a clamping mechanism for fixedly clamping the foundation element;
- a vibrator block configured to provide a vibration for the purpose of inserting the foundation element into the ground, wherein the vibrator block is provided with resilient elements; and
- a fixation mechanism configured to apply a bias to the resilient elements such that movement of the resilient elements is reduced.

By applying a bias to the resilient elements present in the vibrating device with the fixation mechanism relative movements between components of the vibrating device are reduced, and preferably wholly avoided, during positioning thereof. The fixation mechanism makes it possible to as it were temporarily isolate the resilient elements from the play of forces. The resilient elements are formed by for instance springs, rubbers, elastomers or other resilient elements. These resilient elements serve the purpose of not transmitting to the rest of the installation the forces exerted on the foundation element during the vibration process.

During positioning of the foundation element with the vibrating device, wherein a rotation is for instance performed with the rotation mechanism such that the foundation element is lifted and erected with the vibrating device, a relatively great movement is found to occur in practice as a result of the forces occurring during the positioning. An offshore foundation element weighs for instance about 1800 tons and has a diameter of for instance about 6 meters. This results in great forces being exerted on the device. The relative movements, particularly during positioning, result in wear of components, in particular the resilient elements, whereby the lifespan of the vibrating device is significantly limited. This also results in practical problems in respect of for instance the operational availability of vibrating devices when for instance a plurality of foundation elements have to be placed offshore with one and the same vibrating device.

The forces occurring during the positioning of the foundation element with the vibrating device are exceptionally great in the case where a vibrating device is arranged on a foundation element which is still in a non-vertical position, i.e. has not yet brought into a vibration position. This means that the assembly of vibrating device and foundation element still has to be rotated to a substantially vertical vibration position before use. Such a movement is also referred to as upending. With conventional systems damage occurs here in practice to the resilient elements in particular, due to the relative movements which components of the vibrating device perform relative to each other. Through the use of the fixation mechanism, with which the resilient elements are placed under a bias, this damage is reduced or even wholly avoided, so that the lifespan of the vibrating device according to the invention is significantly increased.

The foundation element can be provided in diverse forms, including a pile, tube, pipe and the like. The foundation element particularly also comprises a tubular foundation pile provided with a flange on which a construction such as a wind turbine is placeable.

The fixation mechanism preferably comprises a number of cylinders for applying a bias to the resilient elements. The number amounts for instance to one, two or four cylinders. It will be apparent that a different number of cylinders can also be used. Extending the cylinders for instance results in the resilient elements being isolated from the play of forces for the lifting process. This whole or at least partial blocking of the resilient elements achieves that substantially no relative movement occurs between components of the vibrating device during positioning of the vibrating device, in particular during upending of the assembly of vibrating device and foundation element.

In an advantageous preferred embodiment according to the present invention the vibrating device comprises a rotation mechanism operatively connected to the vibrator block and configured to rotate the vibrator block with the resilient elements, wherein the clamping mechanism fixedly holds the foundation element.

Providing a rotation mechanism makes it possible to perform the upending already described above. The combination of rotation mechanism with clamping mechanism and resilient elements achieves that undesired damage to components resulting from the forces which occur are reduced and preferably even wholly avoided. Said combination is found to significantly improve the operational availability of the vibrating device in practice.

In an advantageous preferred embodiment according to the present invention the rotation mechanism comprises a cylinder.

Providing the rotation mechanism with a cylinder enables a rotation for the purpose of for instance upending to be performed in effective manner. The use of a winch and/or lifting installation is not required here for this rotation movement. This increases the convenience of use of the vibrating device according to the invention. In addition, a cost-effective vibrating device is hereby provided. The time duration required for the rotation process is hereby also limited during use so that the whole process of arranging a foundation element can be performed more efficiently.

A further additional advantage of the vibrating device according to the present invention is that the frame can be provided in relatively simple manner with more than one vibrator block, for instance two, four or even more. It is hereby possible in effective manner to apply a greater power for the purpose of inserting a foundation element. In such an embodiment with a plurality of vibrator blocks use is preferably made of a base frame and a so-called spreader bar.

In an advantageous preferred embodiment according to the present invention the clamping mechanism comprises:

- a frame provided with a number of cylinders;
- a number of clamping means connected operatively to the cylinders for the purpose of clamping a foundation element;
- positioning means connected operatively to the clamping means such that the clamping means engage round an edge of the foundation element; and
- connecting means connected to the frame for connecting the frame to the vibrating device.

Providing clamping means, preferably in the form of grippers, achieves that a foundation pile of differing dimensions and/or configurations can be fixedly clamped. Flexible use of the device according to the invention hereby becomes possible. Use is preferably made here of a number of preferably hydraulic cylinders for managing the forces required.

The device according to the invention is particularly suitable for clamping a foundation pile provided with a flange on the outer end of the foundation pile directed upward in use. Such a flange is advantageous for placing preferably a wind turbine thereon or thereat. Such a wind turbine can in this way be placed in effective manner. Owing to the flexible device according to the invention such a foundation pile provided with a flange can be placed in the ground in effective and efficient manner both on land and at sea.

It has been found that forces which are generated by a vibrator block arranged with the connecting means during placing of a foundation element in the ground can be transmitted in effective manner to the foundation element, in particular a tubular foundation pile provided with a flange on which a wind turbine is placeable.

In an advantageous preferred embodiment use is made of two preferably substantially horizontally disposed cylinders.

It has been found that providing at least two cylinders per clamping means results in good operation of the device. The cylinders displace the clamping means in order to thereby place them over a flange and subsequently allow them to engage on for instance a tube wall of the foundation pile. The preferably substantially horizontal arrangement of the cylinders realizes a simple configuration and operation of the device according to the invention.

In an advantageous preferred embodiment according to the invention the clamping means comprise a clamping mechanism and second positioning means for positioning a clamping mechanism relative to a wall of the foundation element.

A greater flexibility of the device according to the invention is obtained by providing a clamping mechanism and second positioning means. The clamping mechanism is preferably driven by a separate hydraulic cylinder.

In a further advantageous preferred embodiment according to the invention the vibrating device comprises an auxiliary frame configured to arrange the vibrating device thereon in a position of the foundation element lying wholly or partially on the auxiliary frame.

Through the use of an auxiliary frame, usually also referred to as an upend frame, a vibrating device can be arranged on or at a foundation element while the foundation element is situated on the auxiliary frame in a non-vertical position. Use of the auxiliary frame achieves that arranging of the vibrating device on the foundation element can be performed in simpler manner. The assembly of vibrating device and foundation element is then carried into the desired substantially vertical vibration position by subsequently rotating the assembly with the above discussed blocking/biasing of the resilient elements, wherein no undesirable effects occur on (parts of) the vibrating device as a result of the relatively great forces which occur during the rotation movement. In addition to a greater safety, a relatively long lifespan of the vibrating device and other advantages are hereby also realized, wherein it is possible to suffice with a minimum of maintenance operations.

The rotation mechanism is preferably configured such that, after the vibrating device has been arranged on the foundation element, the assembly of vibrating device and foundation element rotates through an angle to a substantially vertical vibration position in the range of 60 to 85 degrees, preferably in the range of 70 to 83 degrees, and most preferably about 80 degrees.

A particular advantage of utilizing an angle of rotation in said ranges, in particular about 80 degrees, is that the vibrating device can be arranged in relatively simple manner on the foundation element. The vibrating device can in particular be guided in as it were self-aligning or self-locating manner into a tubular foundation element. The movements required and the associated forces exerted are hereby limited compared to arrangement of a vibrating device on a foundation element placed fully horizontally, wherein the vibrating device must for instance be pulled into the foundation element.

A further advantage of the rotation through an angle in said ranges, in particular about 80 degrees, is that a more effective equilibrium of forces is hereby obtained, particularly in an offshore application. The foundation element can be placed in the auxiliary frame and, because of the angle to the horizontal plane, can already be positioned with a lower outer end in the water or close to the water surface. This has the advantage that the upward force of the water reduces the necessary lifting forces. This makes positioning simpler, and in addition relative movement of components is further reduced.

The invention also relates to a kit comprising a fixation mechanism configured to apply a blocking or movement limitation to the resilient elements, and connecting elements for arranging the fixation mechanism on a vibrating device for the purpose of providing a vibrating device as described above.

The kit provides the same advantages and effects as described for the vibrating device. The kit can particularly be applied as a separate build-in or surface-mounted unit which can optionally be mounted on a vibrating device. The kit according to the invention has the additional advantage here of also being suitable for use on already existing vibrating devices which can be modified therewith, for instance when they are going to be used for offshore applications.

The invention also relates to a method for inserting a foundation element into the ground, the method comprising of providing a device and/or vibrating device as described above.

The method provides the same advantages and effects as described for the device and/or vibrating device.

The method according to the invention preferably comprises of applying a blocking/bias to the resilient elements with the fixation mechanism. The advantages and effects are hereby realized as stated above in respect of the vibrating device.

The method according to the invention also comprises of rotating the assembly of vibrating device and foundation element to a substantially vertical vibration position following applying of the blocking/bias and clamping of the foundation element. The vibrator block is preferably secured here and rotated prior to mounting, whereby undesired movements are reduced during the rotation and lifting during positioning of the vibrating device with foundation element.

This arrangement of the vibrating device in a non-vertical position on the foundation element followed by rotation of the assembly is particularly advantageous in the case of offshore placing of foundation elements. The arrangement of the vibrating device on or at the foundation element can for instance be carried out here substantially on board a ship, and preferably substantially on or close to the deck of such a ship. In a currently preferred embodiment use is made in this method of an auxiliary frame, i.e. an upend frame. A foundation element can hereby be arranged in a controlled manner in a ground such as a seabed.

The method according to the invention preferably comprises of positioning the clamping means with the positioning means, and engaging with the clamping means, preferably using the clamping mechanism preferably driven by a separate hydraulic cylinder, round or around an edge of the foundation element on preferably a wall of a tubular foundation element. Such an edge particularly comprises a flange, and such a foundation element particularly comprises a tubular foundation pile provided with such a flange.

Figure 4:
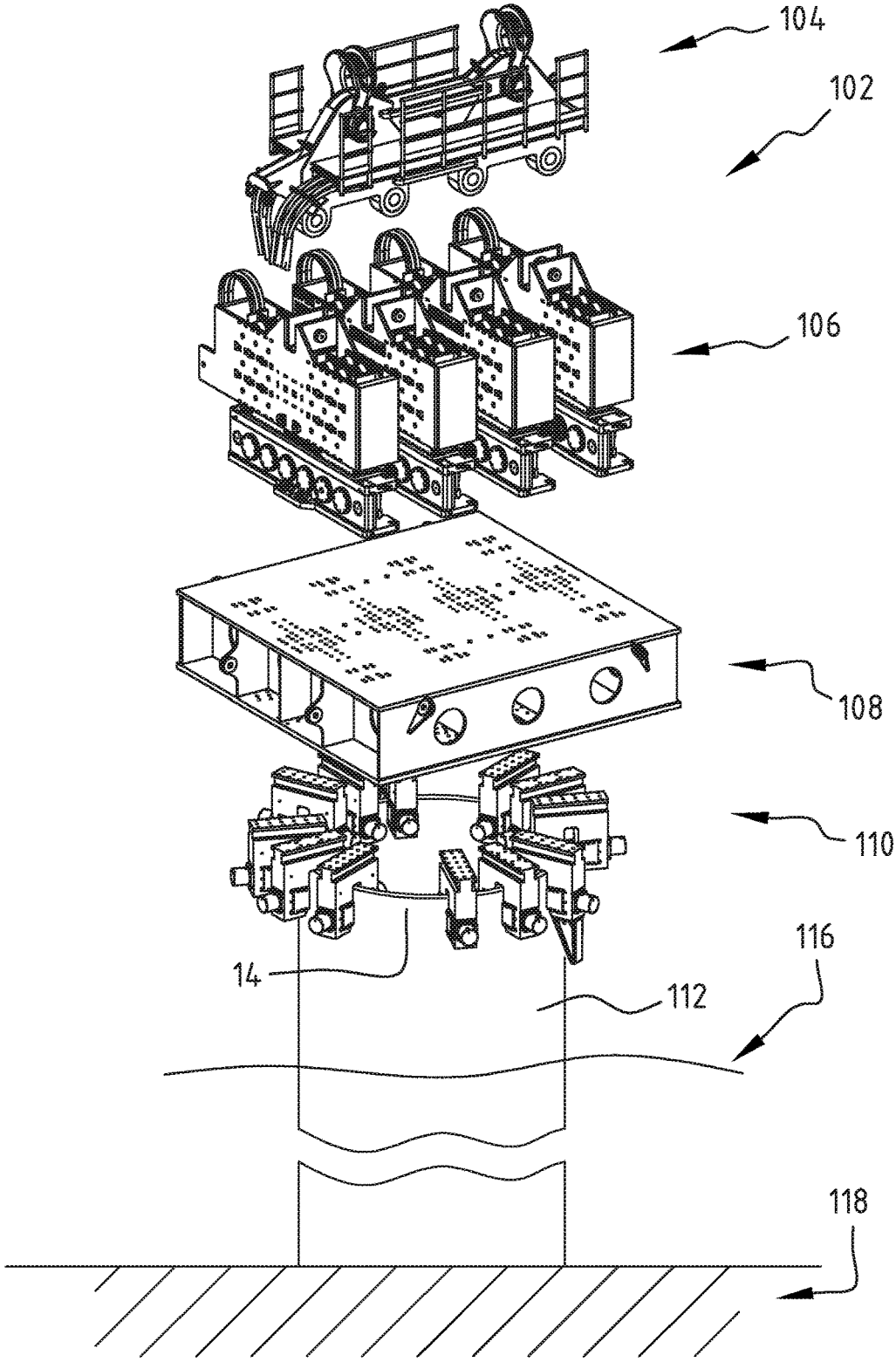
Figure 5B:
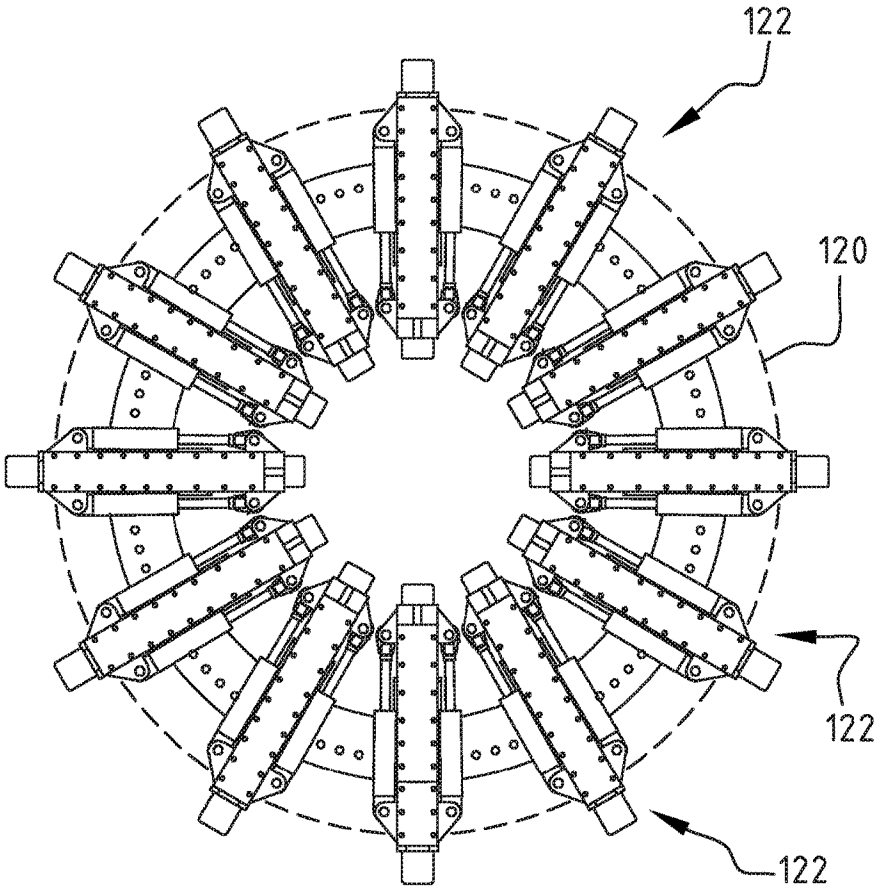
Figure 5A:
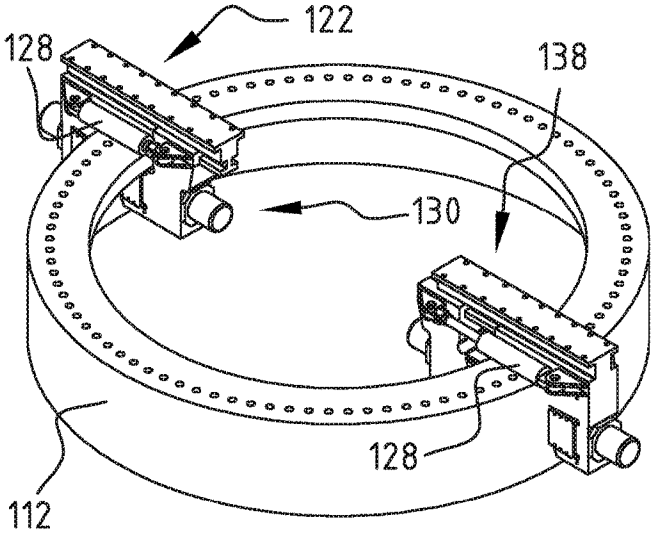
Figure 5D:
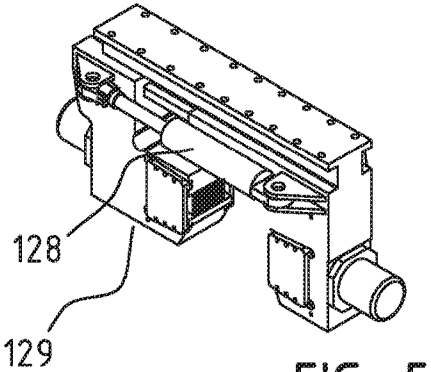
Figure 5C:
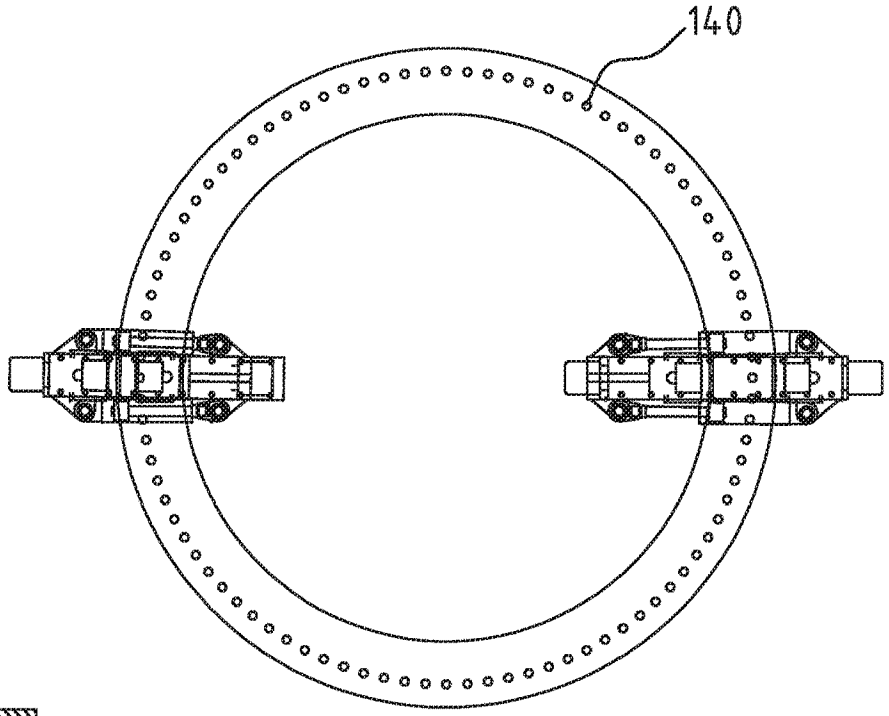
Figure 5F:
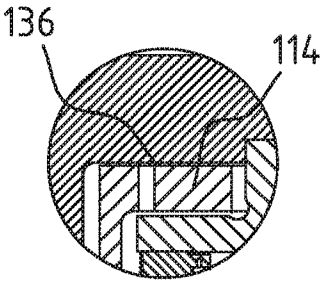
Figure 5E:
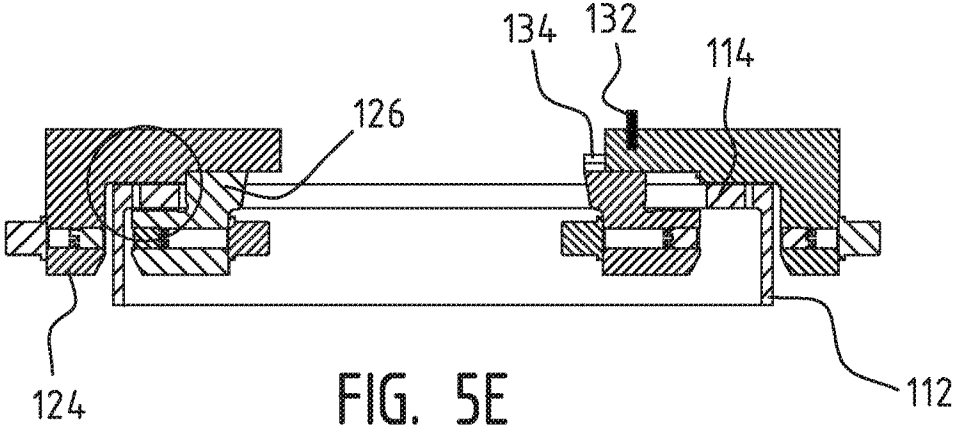

Further advantages, features and details of the invention are elucidated on the basis of a preferred embodiment thereof, wherein reference is made to the accompanying figures, in which:

FIGS. 1A-D show views of a conventional vibrator block and an optional clamping system according to the invention;

FIGS. 2A-D show views of a vibrating device with optional clamping system and a spring system according to the invention;

FIGS. 3A-H show views of a preferred embodiment of the vibrating device according to the invention;

FIG. 4 shows a view relating to a clamping system which can be applied in a vibrating device according to the invention;

FIGS. 5A-F show views of the clamping system of FIG. 4; and

Figure 6:
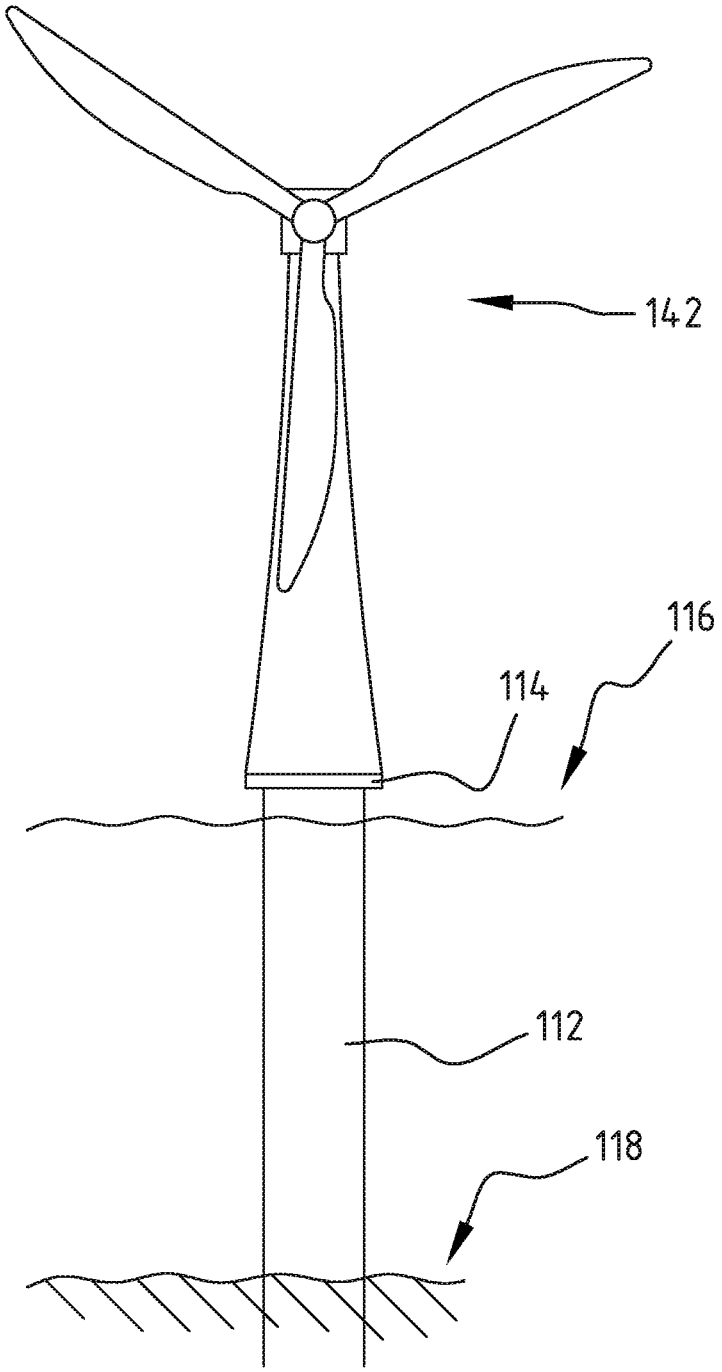

FIG. 6 shows a schematic view of a wind turbine placed according to the invention.

Vibrating system 2 (FIG. 1A) comprises a so-called outer suppressor 4 which is connected via resilient element 6 to the so-called inner suppressor 8. This inner suppressor 8 is mounted on sump 10. Through use of resilient element 6 the transmission of vibrations during driving of foundation element 12 can be isolated from the lifting installation. Connections between inner suppressor 8, sump 10, base frame 14, clamps 16 of clamping mechanism 18 and foundation pile 12 are rigid. Vibrations generated with vibrating device 2 are therefore carried only into foundation pile 12.

Conventional spring system 20 (FIG. 1B) with resilient element 6 and inner suppressor 8 has a flexible suspension. Two-phase system 22 (FIG. 1C) shows spring system 22 with resilient element 6. Spring system 22 is a type of two-phase system with first phase element 24, which forms a relatively flexible connection which isolates vibrations particularly to lifting installation 26. This is therefore mainly relevant during driving or vibration or insertion of foundation pile 12 into the ground. Second phase element 28 realizes a stiffer connection which is not activated during the vibration process but during a pulling process with foundation pile 12, so that a greater load can be lifted.

During upending there occurs in practice an incline 30 (FIG. 1D) because, as a result of the great weights of the assembly of foundation pile 12 and vibrating device 2, great forces are exerted on vibrating device 2, including also resilient elements 6, for instance in the form of rubber blocks. This creates a moment effect on resilient elements 6 such that they are pressed into inclining position. Incline 30 can become so large that both suppressors come into contact with each other. This results in undesired and sometimes unacceptable stresses in the construction. Resilient element 6 will also be overloaded such that even internal connections can be damaged. This limits the lifespan of the vibrator blocks in particular, and thereby the operational availability of such a conventional device.

A vibrating device according to the invention will be elucidated hereinbelow with which incline 30 is reduced and can preferably even be avoided.

Figure 2A:
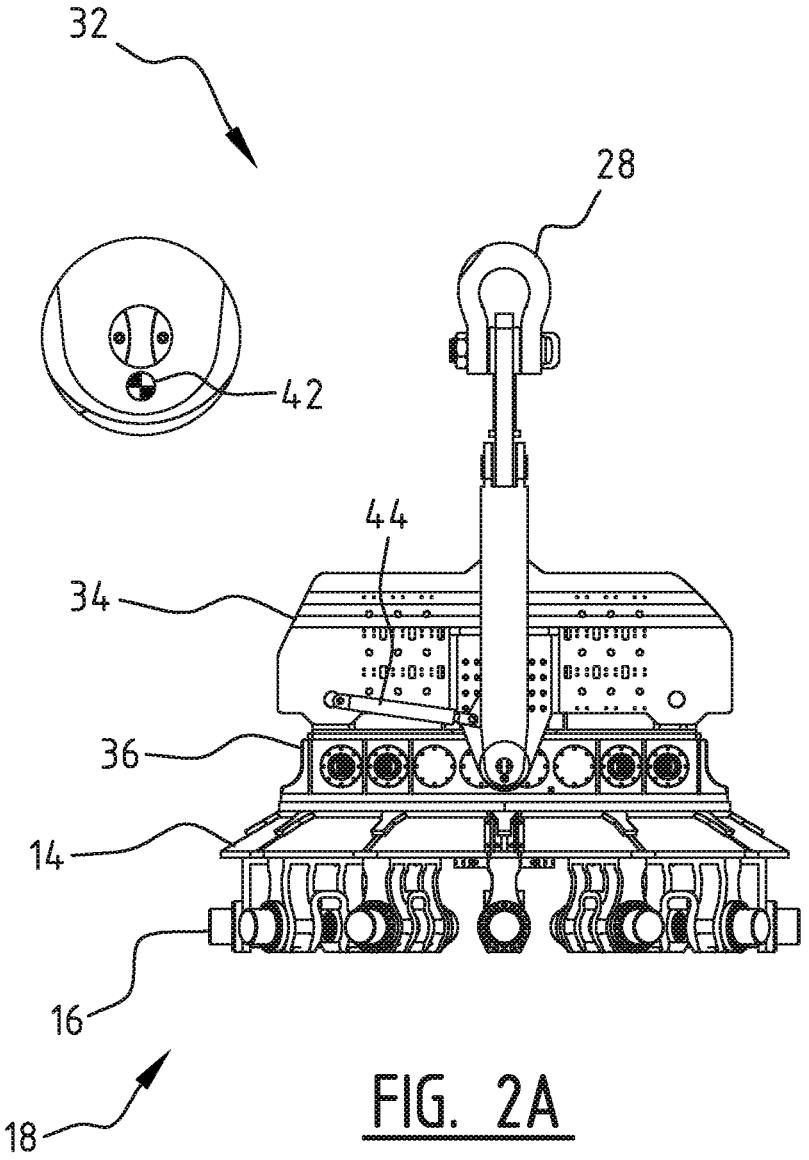
Figure 2B:
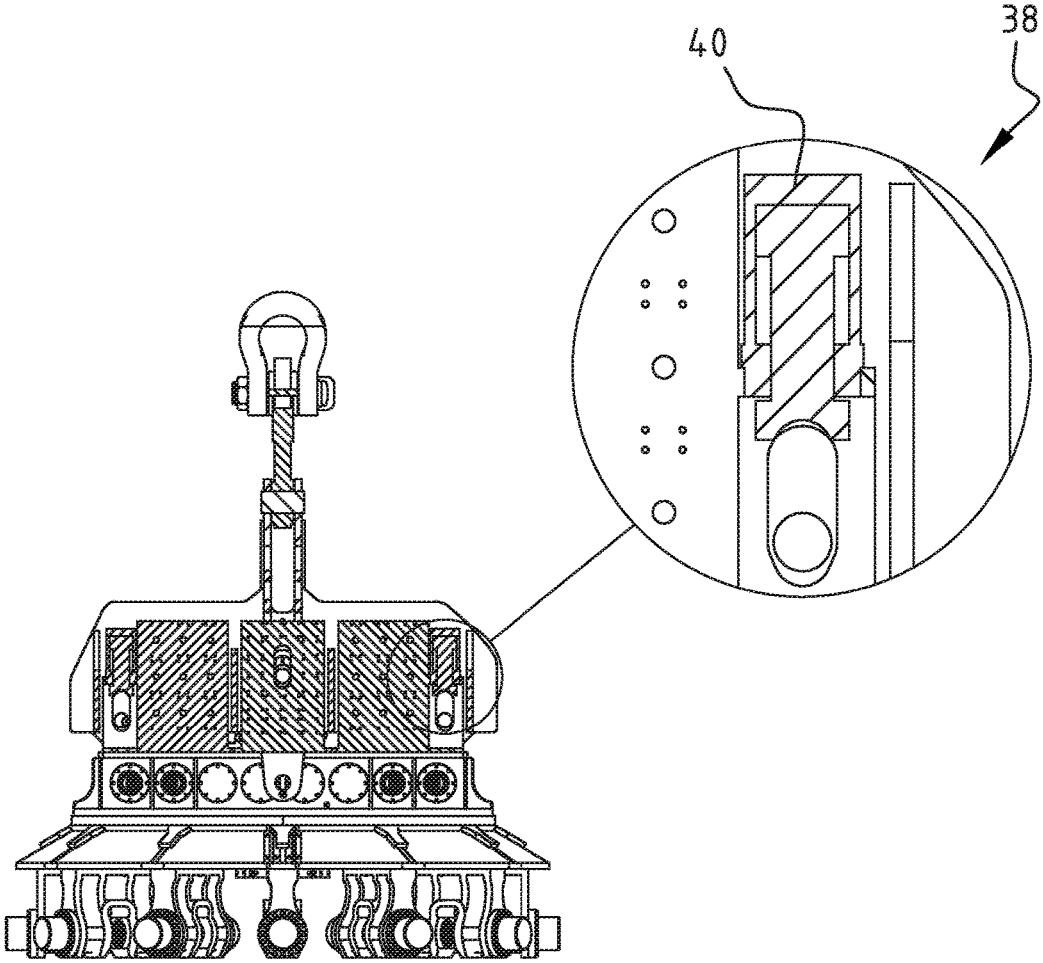
Figure 2C:
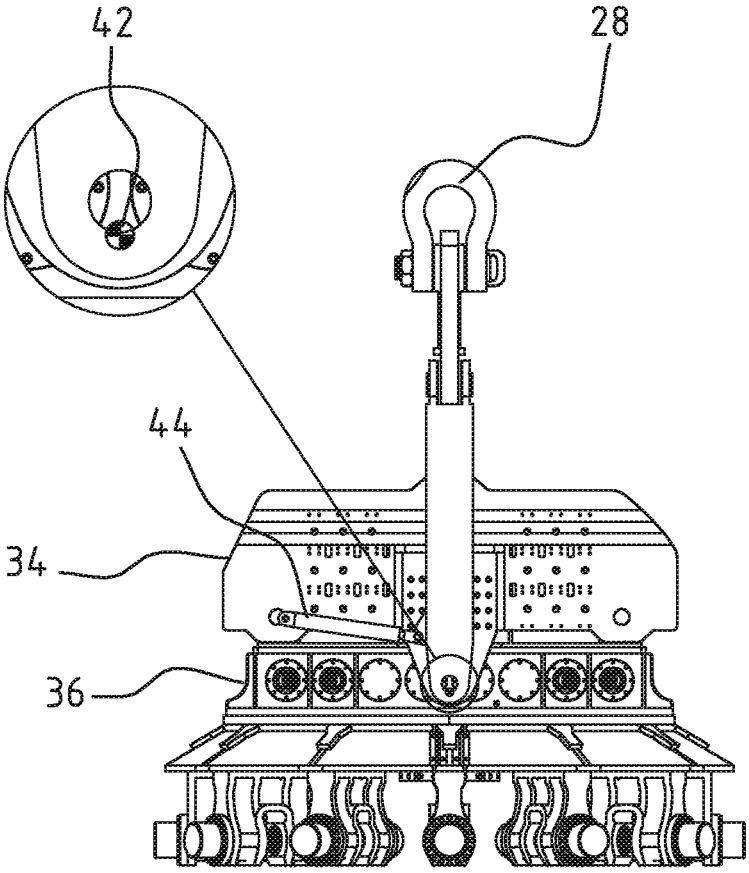
Figure 2D:
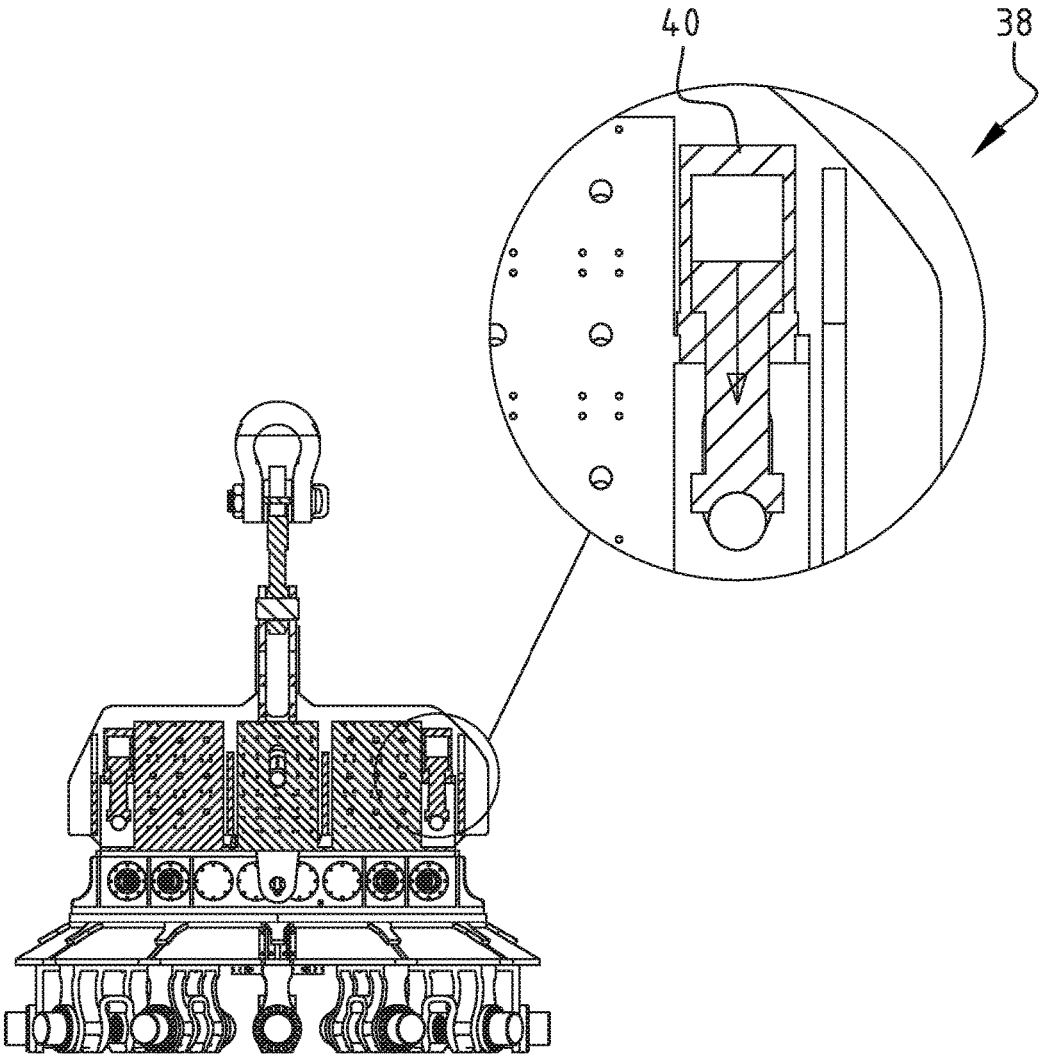

In addition to comprising the regular components such as outer suppressor 34 and sump 36 and components applied in a preferred embodiment according to the invention such as base frame 14 and clamps 16 of clamping mechanism 18, vibrating device 32 (FIGS. 2A-D) in the shown embodiment according to the invention also comprises an adjustable two-phase spring system 38. Spring system 38 is provided with adjusting mechanism/fixation mechanism 40 (FIGS. 2B and D). Adjusting mechanism 40 makes it possible to realize a rigid connection between outer suppressor 34 and sump 36, wherein the mutual distance is reduced. In the shown embodiment the centre of gravity 42 is in addition brought closer to the rotation point of the upending, which has a favourable effect on the rotation from a loading position to a vibration position of the assembly of vibrating device 32 and foundation pile 12. The flexible connection is spared by the activated rigid connection and damage thereto is therefore prevented. In the vibration position adjusting mechanism 40 is switched and resilient elements 6 will provide for a flexible connection.

In the shown embodiment adjusting mechanism 40 is embodied with a type of cylinder, wherein an adjusting mechanism 40 is provided on either side of vibrating device 32, therefore a total of two per vibrating device 32. For the rotation of vibrating device 32 during upending use is made of rotation cylinder 44 which enables a rotation between vibrating device 32 and lifting installation 26. Using cylinder 44 vibrating device 32 can make a rotation movement relative to lifting frame 28. This makes possible the upending of vibrating device 32 assembled with a foundation element 12. The stroke of cylinder 44 is preferably limited to a length such that, even when a cylinder 44 malfunctions, no undesired rotation is possible between vibrating device 32 and lifting frame 28.

Figure 3A:
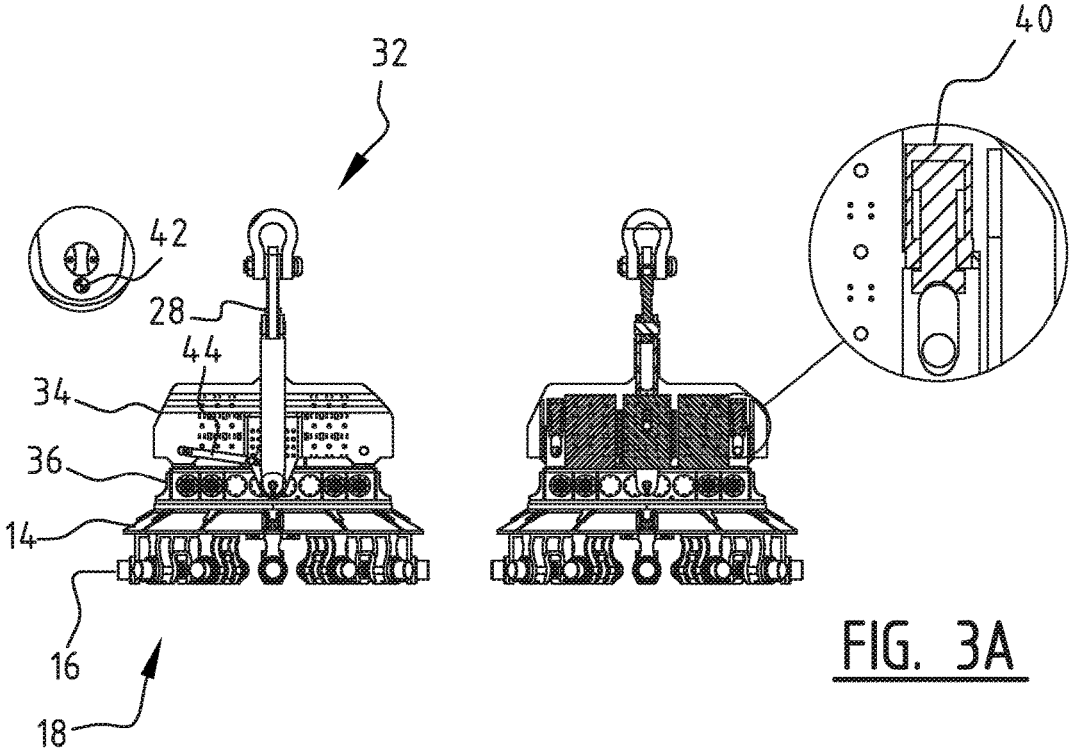
Figure 3B:
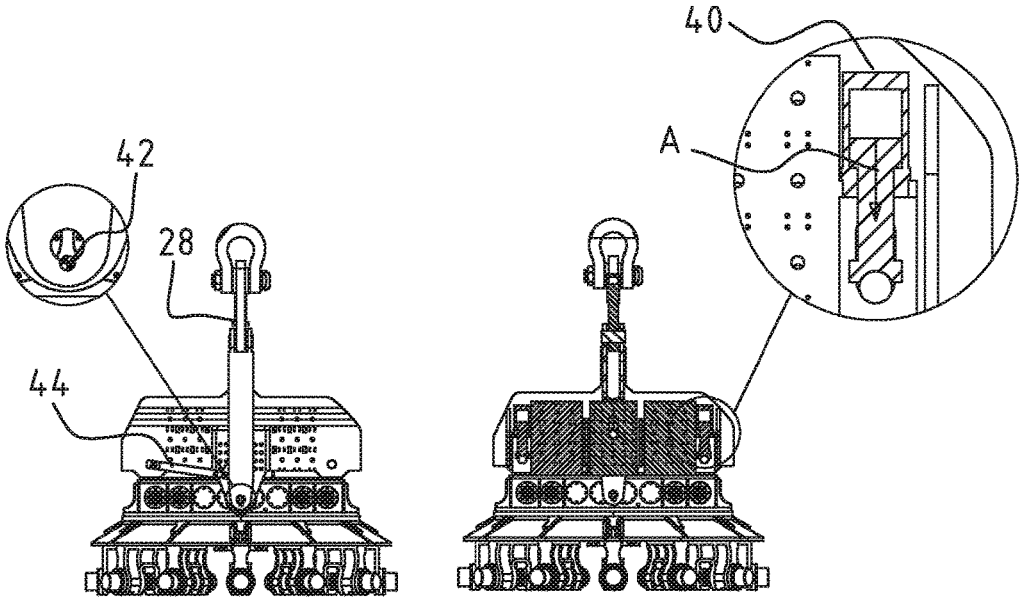
Figure 3C:
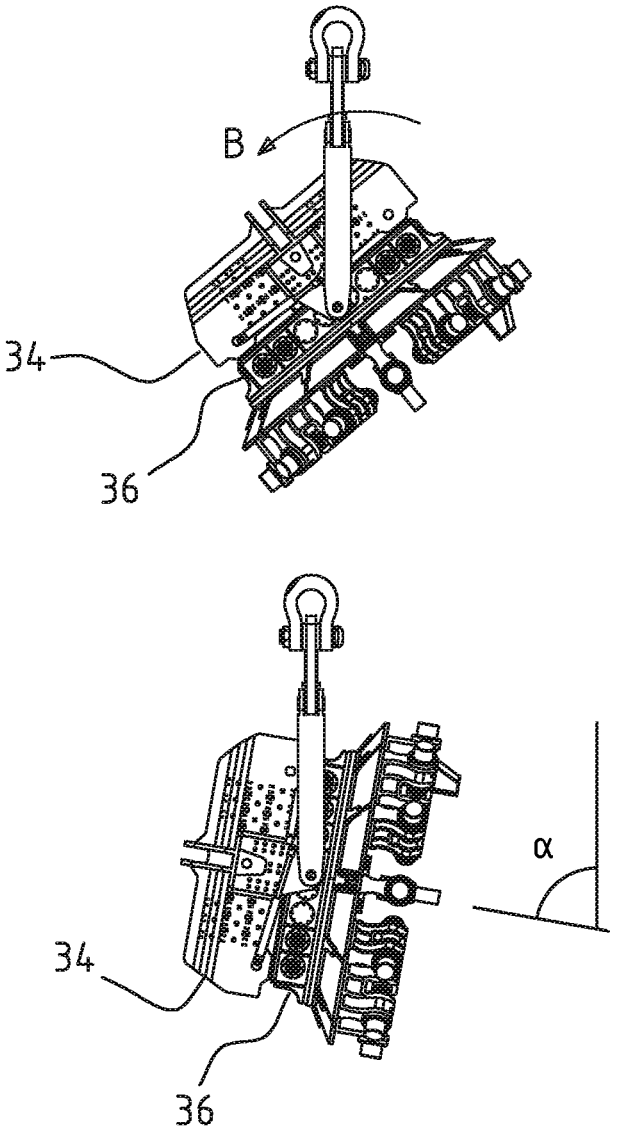
Figure 3D:
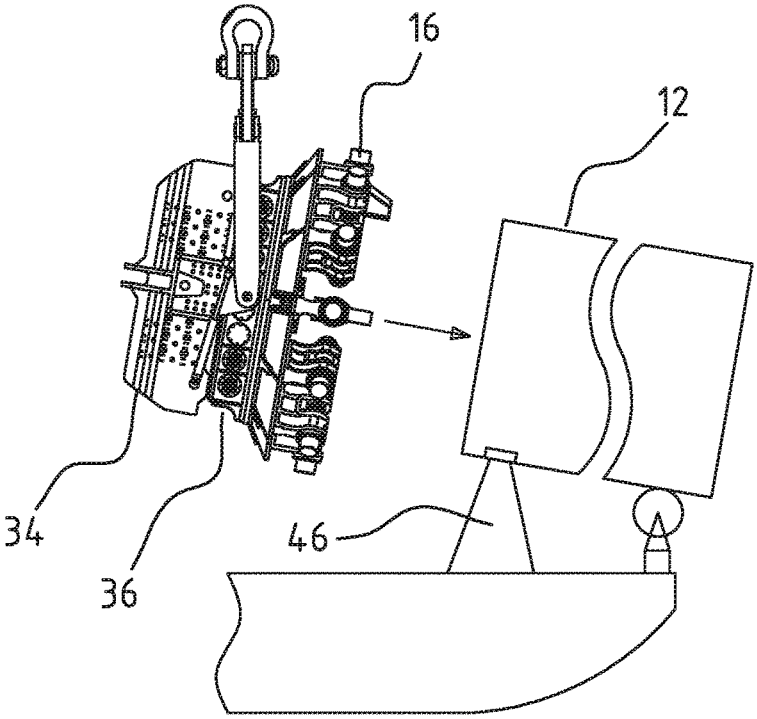
Figure 3E:
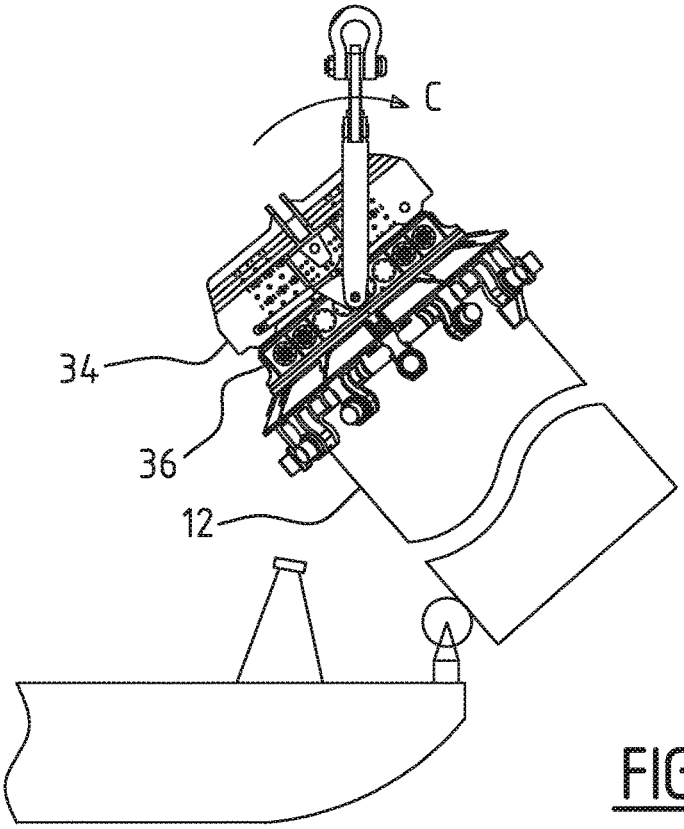
Figure 3F:
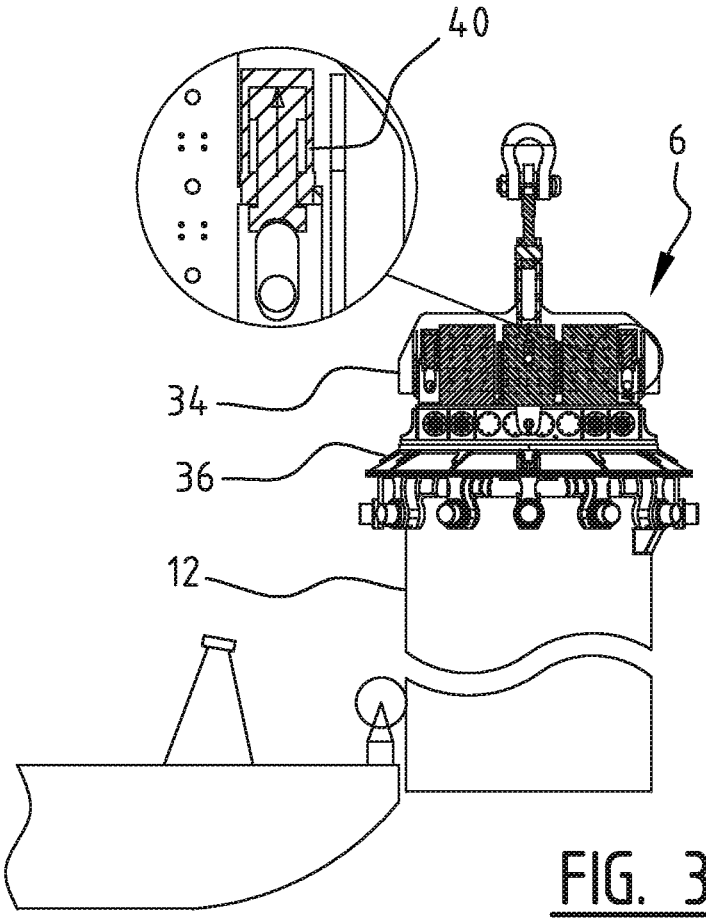
Figure 3G:
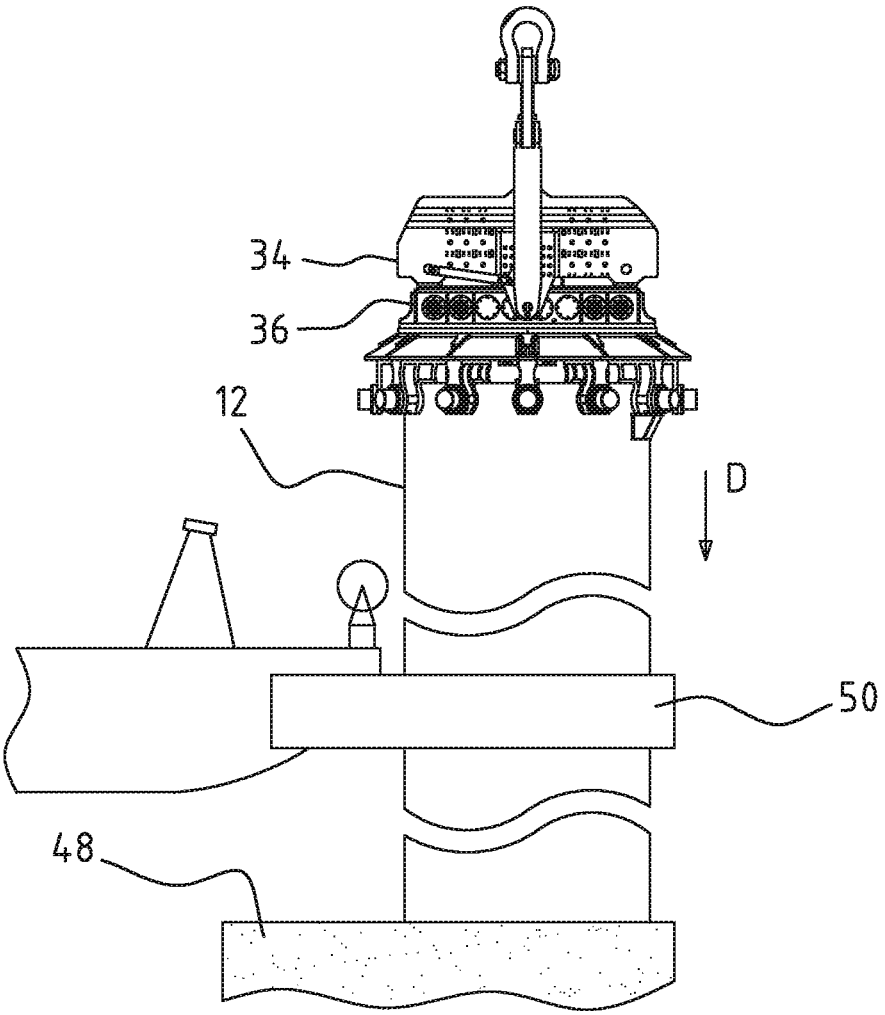
Figure 3H:
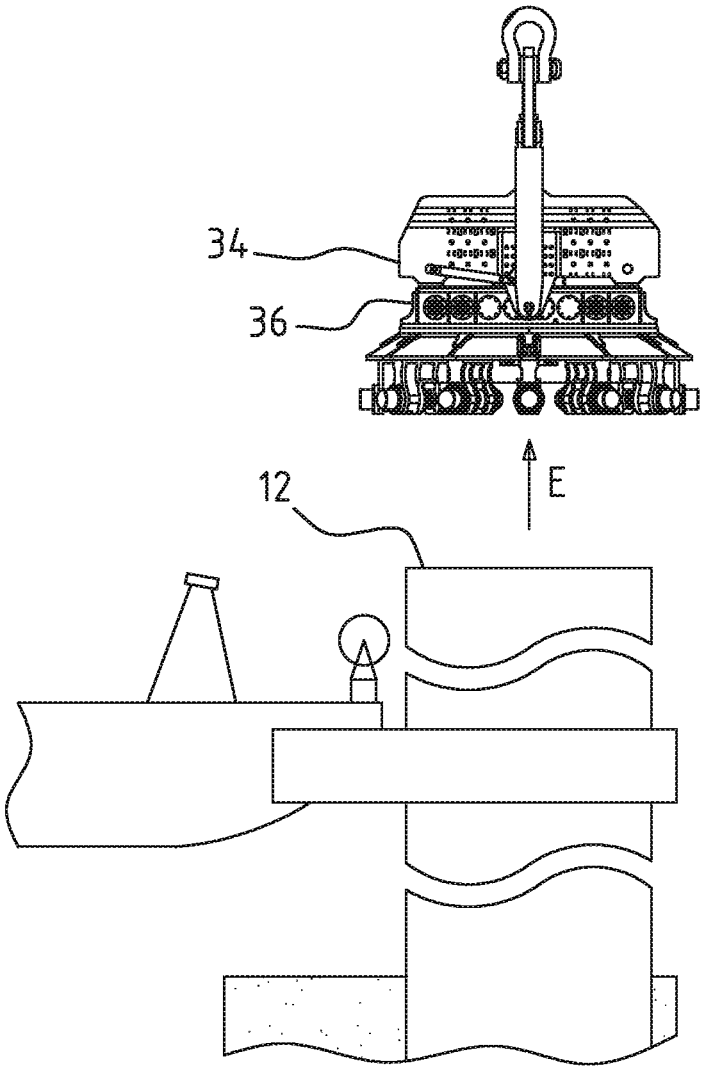

Vibrating device 32 according to the invention (FIGS. 3A-H) shows lifting device 28 wherein outer suppressor 34 and sump 36 are connected flexibly (FIG. 3A). By moving adjusting mechanism 40 in direction A the flexible connection is made rigid by applying a bias to resilient elements 6 (FIG. 3B). A rotation of vibrating device 32 is then performed relative to lifting device 28 in direction B by moving, particularly extending, cylinder 44 (FIG. 3C). Use is made in the shown embodiment of an angle α of about 80 degrees. A locating or self-aligning effect is hereby realized during arranging of vibrating device 32 on or in foundation pile 12 (FIG. 3D) in or on auxiliary frame 46, followed by clamping with clamps 16. Self-locators are optionally applied here in order to further optimize this effect. This avoids separate pulling forces having to be exerted to pull vibrating device 32 to foundation pile 12. It has been found that this self-locating effect can be utilized in particularly effective manner in the case of foundation elements provided with a flange on the upper edge. This effect can otherwise also be applied in advantageous manner to other foundation elements.

Upending (FIG. 3E) can then be performed in direction C. Having arrived in the vibration position (FIG. 3F), adjusting mechanism 40 is switched so as to realize a flexible connection to resilient elements 6. Foundation pile 12 can then be vibrated into the ground 48 in direction D (FIG. 3G), with optional supports 50. Once the desired depth has been reached, vibrating device 32 is removed from foundation pile 12 in direction E (FIG. 3H) and subsequently deployed on for instance a following foundation pile 12 to be inserted into the ground 48.

Four vibrator blocks 32 are optionally placed adjacently of each other on base frame 14. Forces are hereby distributed as well as possible. The base frame comprises beams for distributing the forces exerted on the foundation element, in particular foundation pile 12 or foundation tube. Clamping mechanism 18 is embodied for this purpose in the shown embodiment with twelve clamping means or clamps 16, a further embodiment of which is elucidated below. In the shown embodiment clamps 16 are embodied such that they can engage in relatively simple manner over an optional flange arranged on an upper edge of foundation pile 12. This makes mounting of the construction, such as a wind turbine, on the foundation element at a later stage considerably simpler. Clamps 16 are connected in the shown embodiment to base frame 14 with a bolt connection.

Resilient elements 6 which are embodied in the shown embodiment as a type of rubber blocks of an elastomer material ensure that during use vibrations are exerted on foundation pile 12 and are not transmitted unnecessarily to the other parts of the overall vibration installation. Using two cylinders/adjusting mechanisms 40 a bias can be applied to these resilient elements 6 such that movement of resilient elements 6 is reduced thereby during positioning. Cylinders 40 are for this purpose retractable, wherein cylinders 40 engage for instance on a pin/shaft which then compresses resilient elements 6 by moving first part 34 and second part 36 of vibrating device 32 toward each other. It will be apparent that a different number of cylinders 40 and a different configuration, wherein cylinders 40 engage for instance directly on resilient elements 6, are also possible according to the invention.

The placing of a foundation pile in the form of a tube element in an offshore application using the vibrating device and the method according to the invention will now be further elucidated in an application wherein a foundation element is used as foundation for a wind turbine. It will be apparent that measures of the different shown embodiments according to the invention can be interchanged with each other or otherwise combined. The clamping system, which is elucidated in more detail below, can for instance thus be applied as clamping system in the foregoing embodiment.

System 102 (FIG. 4) is provided with a lifting system 104, one or more vibrator blocks 106, in the shown embodiment four vibrator blocks 106 positioned adjacently of each other, a box structure 108 and a device 110 according to the invention for clamping a foundation pile 112, and in particular on a flange 114 thereof. In the shown embodiment pile 112 is inserted into the ground 118 at sea 116. Device 110 is provided with a connecting frame 120 and, additionally or alternatively, structure 108 on which diverse clamping elements 122 are arranged.

Clamping element 122 (FIGS. 5A-F) comprise in the shown embodiment a fixed outer part 124 and a displaceable inner part 126, wherein parts 124, 126 are provided for displacement by two cylinders 128. When element 122 is arranged, parts 124, 126 are first moved apart and placed over flange 114. Parts 124, 126 are then displaced toward each other by cylinders 128 and secured on pile 112 with movable clamp 129. In the shown embodiment movable clamp 129 is moved using cylinder 130 and an actual clamping is realized on pile 112. In order to prevent displacement of displaceable clamping part 126 fixation elements 132 comprising a separate cylinder are provided in the shown embodiment which fix clamping part 126 relative to T-shaped guide rails 134.

Also provided in the shown embodiment are flange protectors 136 for avoiding damage to flange 114. Also arranged on clamping element 122 are connection points 38 for arranging the other components of the vibration system directly or indirectly thereon. Arranged in the shown embodiment are connection points 140 around which for instance wind turbine 142 can be placed and/or optional clamping system 122 can be fixed.

In the shown embodiment the inner diameter of flange 14 is about 4400 mm and the outer diameter about 5500 mm.

A wind turbine (FIG. 6) is placed at sea 160 in the ground 180. The turbine is arranged here on flange 114 of pile 112.

The invention is by no means limited to the above described preferred embodiments thereof. The rights sought are defined by the following claims, within the scope of which many modifications can be envisaged.

The invention claimed is:

1. A vibrating device for inserting a foundation element into the ground, the device comprising:

a clamping mechanism for fixedly clamping the foundation element;

a vibrator block configured to provide a vibration for inserting the foundation element into the ground, wherein the vibrator block is provided with resilient elements;

a fixation mechanism including a plurality of cylinders movable between a first position and a second position, wherein in the second position, the plurality of cylinders bias the resilient elements; and a rotation mechanism operatively connected to the vibrator block and configured to rotate the vibrator block with the resilient elements so that the foundation element can be moved from a first, non-vertical position to a second, substantially vertical vibrational position;

wherein, when in the second position, the plurality of cylinders bias the resilient elements while the foundation element is moved from the first, non-vertical position to the second, substantially vertical vibrational position to minimize damage to the resilient elements.

2. A vibrating device as claimed in claim 1, wherein the rotation mechanism comprises a cylinder.

3. A vibrating device as claimed in claim 1, further comprising two or more vibrator blocks.

4. A vibrating device as claimed in claim 1, wherein the clamping mechanism comprises:

a frame provided with a number of cylinders; and a number of clamps connected operatively to the cylinders for the purpose of clamping a foundation element;

wherein the clamps are positionable to engage around an edge of the foundation element;

wherein the frame is connected to the vibrating device.

5. A vibrating device as claimed in claim 4, wherein two cylinders are provided per clamp.

6. A vibrating device as claimed in claim 4, wherein the clamps position the clamping mechanism relative to a wall of the foundation element.

7. A vibrating device as claimed in claim 1, wherein the vibrating device is arrangeable on the foundation element by an auxiliary frame, the vibrating device being configured to lay wholly or partially on the auxiliary frame.

8. A vibrating device as claimed in claim 1, wherein the rotation mechanism is configured for the purpose, after the vibrating device has been arranged on the foundation element, of rotating the assembly of vibrating device and foundation element through an angle to a substantially vertical vibration position, wherein the angle lies in the range of 60 to 85 degrees.

9. A vibrating device as claimed in claim 1, wherein the foundation element comprises a tubular foundation pile provided with a flange.

10. A vibrating device as claimed in claim 1, wherein the fixation mechanism comprises a number of cylinders.

11. A vibrating device as claimed in claim 10, wherein the rotation mechanism comprises a cylinder.

12. A vibrating device as claimed in claim 11, wherein the rotation mechanism is configured for the purpose, after the vibrating device has been arranged on the foundation element, of rotating the assembly of the vibrating device and the foundation element through an angle to a substantially vertical vibration position, wherein the angle lies in the range of 60 to 85 degrees.

13. A vibrating device as claimed in claim 12, wherein the clamping mechanism comprises:

a frame provided with a number of cylinders; and a number of clamps connected operatively to the cylinders for the purpose of clamping a foundation element;

wherein the clamps are positionable to engage around an edge of the foundation element;

wherein the frame is connected to the vibrating device, and wherein two of the cylinders are provided per clamp.

14. A kit comprising a fixation mechanism configured to apply a blocking or movement limitation to the resilient elements, and connecting elements for arranging the fixation mechanism on a vibrating device for the purpose of providing a vibrating device as claimed in claim 1.

15. A method for inserting a foundation element into the ground, the method comprising of providing a vibrating device as claimed in claim 1.

16. A method as claimed in claim 15, comprising of applying a bias to the resilient elements with the fixation mechanism.

17. A method as claimed in claim 16, further comprising rotating the assembly of the vibrating device and the foundation element to a substantially vertical vibration position following applying of the bias and clamping of the foundation element.

18. A method as claimed in claim 15, further comprising positioning the clamps with fixation elements of a clamping mechanism and engaging with the clamps around at least an edge of the foundation element or on a wall of the foundation element.

* * * * *